United States Patent [19]

Kubis et al.

[11] Patent Number: 4,834,259

[45] Date of Patent: May 30, 1989

[54] PULL TAB STORAGE AND METHOD OF EFFECTING SAME

[75] Inventors: Charles S. Kubis, Palos Heights; John Walter, Evergreen Park, both of Ill.

[73] Assignee: Continental Can Company, Inc., Norwalk, Conn.

[21] Appl. No.: 207,498

[22] Filed: Jun. 16, 1988

[51] Int. Cl.[4] ..... B65D 5/64; B65D 17/34

[52] U.S. Cl. ..... 220/359; 229/125.35; 220/270

[58] Field of Search ..... 220/258, 270–273, 220/359; 206/633; 229/125.33–125.35; 215/232

[56] References Cited

U.S. PATENT DOCUMENTS

| | | | |
|---|---|---|---|
| 3,109,576 | 11/1963 | Karl | 206/633 |
| 3,892,351 | 7/1975 | Johnson et al. | 220/359 |
| 3,961,566 | 6/1976 | Westphal et al. | 220/359 |
| 4,280,653 | 7/1981 | Elias | 220/359 |
| 4,324,343 | 4/1982 | Moller | 220/359 |
| 4,445,620 | 5/1984 | Brochman et al. | 220/271 |

*Primary Examiner*—Stephen Marcus

*Attorney, Agent, or Firm*—Charles E. Brown; Paul Shapiro; Charles A. Brown

[57] ABSTRACT

This relates to a package wherein there is a container having bonded thereto for removal a peelable lid. The lid is provided with a pull tab extension to facilitate one pulling on the lid to effect removal of the lid from the associated container. The pull tab is releasably stored by folding the pull tab upon itself so as to overlie the lid and thereafter releasable bond the pull tab nose to the underlying lid to assure that the pull tab is retained during handling of the package in a position closely overlying the lid and out-of-the-way. When it desired to utilize the pull tab, the bond between the pull tab and the lid is released and the pull tab is moved upwardly and forwardly to a position where it may be readily gripped between ones thumb and adjacent finger to apply the necessary pull on the lid to effect the peeling thereof from the container.

7 Claims, 1 Drawing Sheet

PULL TAB STORAGE AND METHOD OF EFFECTING SAME

This invention relates in general to new and useful improvements in forming packages wherein there is a container closed by a removable lid having an integral pull tab for effecting removal of the lid, and more particularly to a manner of storing such pull tab.

There is on the market packages for food which include a container formed at least in part of a heat bondable plastic to which there is heat bonded lid for removal. In order to facilitate the removal of such lid in a tearing-off manner, the lid is provided with an extension in the form of a pull tab to facilitate such removal of the lid. The pull tab being an extension of the lid, therefore when the package is formed, the pull tab projects beyond the remainder of the package in an undesirable manner.

Accordingly, it is an object of this invention to effect temporary storage of the pull tab. In accordance with the invention, the pull tab is folded back upon itself into overlying relation with respect to the lid.

Further, in accordance with this invention, the pull tab is retained in its storage location by a spot heat bond between the pull tab free end portion and an underlying part of the container lid.

With the above and other objects in view that will hereinafter appear, the nature of the invention will be more clearly understood by reference to the following detailed description, the appended claims and the several views illustrated in the accompanying drawings.

IN THE DRAWINGS

Figure 1:
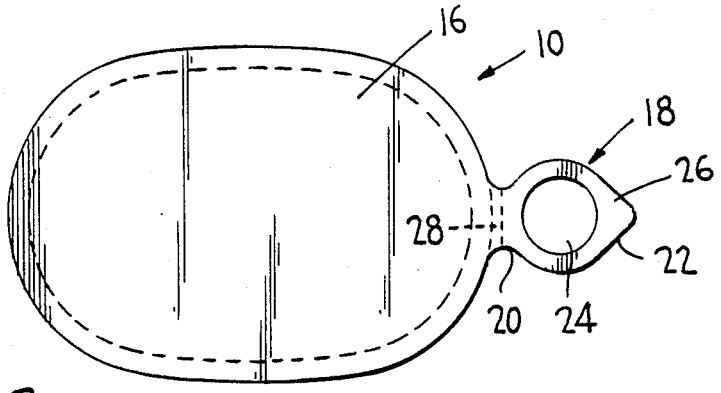
FIG. 1 is a plan view of a newly formed package where a removable lid of the package is provided with a projecting integral pull tab.
Figure 2:
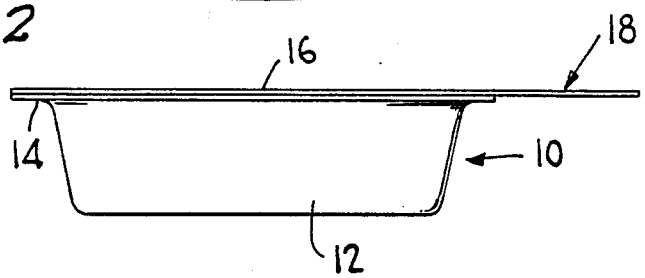
FIG. 2 is an elevational view of the package of FIG. 1 and shows further the details thereof as formed.

Referring now to the drawings in detail, reference is made to FIGS. 1 and 2 wherein there is illustrated a package generally identified by the numeral 10. The package 10 is formed of a container 12 which may be in the form of a container and which is provided with a peripheral flange 14. The container 12 has placed therein a product, such as a food, and is thereafter sealed by way of a lid 16 which overlies the container 12 in closing relation. The lid 16 is secured to the container flange 12 preferably by heat bonding.

In a preferred embodiment of the package 10, the container 12 has at least an inner layer thereof formed of a heat bondable plastic. Opposite faces of the lid 16 are also formed of a heat bondable plastic so that the lid 16 may be readily bonded to the flange 14 in a manner whereby it may be removed from the container 12 by peeling.

In order to facilitate the peeling of the lid 16 from the container flange 14, the lid 16 has formed integral therewith as an extension thereof a conventionally shaped pull tab 18. The pull tab 18 has a neck portion 20 which is of a reduced width and which is integrally connected to the lid 16. The pull tab 18 also has a grip portion 22 with a finger receiving opening 24 therethrough. The pull tab 18 terminates in a nose 26.

It will be readily apparent that the package 10, as initially formed, undesirably has the pull tab 18 projecting therefrom. The pull tab 18 being formed of relatively thin material and being readily deformable, must be protected during shipment and storage.

Figure 3:
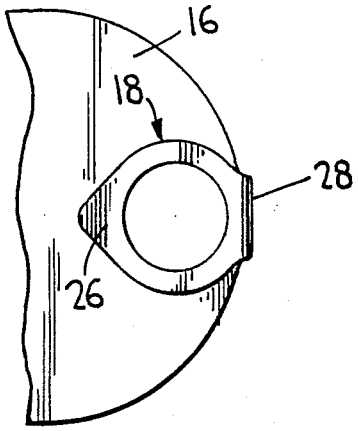
FIG. 3 is a fragmentary plan view on a larger scale showing the pull tab folded upon itself into overlying relation with respect to the container lid in a stored position.
Figure 4:
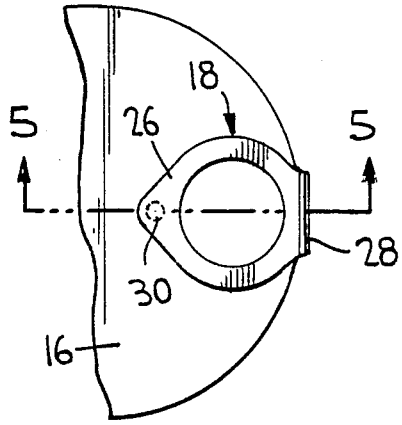
FIG. 4 is a fragmentary enlarged plan view similar to FIG. 3 showing the pull tab retained in its stored position by way of a spot heat bond.

In accordance with this invention, as is shown ifn FIGS. 3 and 4, the pull tab 18 is first folded upon itself as at 28 through the weakened area 20. The line of fold 28 is shown by way of a guide line in FIG. 1. It will be readily apparent that in its initially folded position, the pull tab 18 substantially fully overlies the lid 16 and is in an out-of-the way position.

Figure 5:
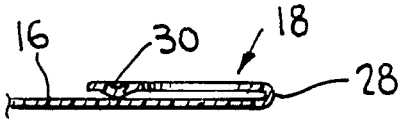
FIG. 5 is an enlarged fragmentary sectional view taken only through the lid and pull tab and shows further the relationship of the two.

In order that the pull tab 18 may be retained in an out-of-the way position, the nose 26 of the pull tab is releasably secured to the lid 16 by a rupturable spot heat bond 30. Since the pull tab 18 is thus held in a position closely overlying the lid 16, as shown in FIG. 5, the pull tab 18 is stored against damage during the handling of the package 10. It is to be understood that the bond between the pull tab 18, which has opposite faces thereof formed of heat bondable plastic, may be very similar to the peelable bond between the lid 16 and the flange 14.

When it is desired to open the container 12, the pull tab 18 is separated from the lid 16 and then pulled upwardly and forwardly to a position where it may be readily gripped. The pull tab 18 will then be pulled upwardly and rearwardly in a normal manner to peel the lid 16 from the container flange 14.

Although only a preferred embodiment of the pull tab storage has been specifically illustrated and described herein, it is to be understood that minor variations may be made in the storage of the pull tab including the method of storing the same without departing from the spirit and scope of the invention as defined by the appended claims.

We claim:

1. A package comprising a container and a lid, a peripheral portion of said lid being secured to said container for overall tear-off removal, said lid having an integral pull tab extension initially projecting beyond said container, said pull tab being folded back on said lid free of an underlying peripheral portion of said lid, and securing means releaseably securing said pull tab directly to an underlying portion of said lid for temporarily retaining said pull tab in an out-of-the-way position.

2. A package according to claim 1 wherein said securing means is a heat bond.

3. A package according to claim 1, wherein said lid and said pull tab have opposite faces formed of a heat bondable plastic, and said securing means is a heat bond between said faces.

4. A package according to claim 2 wherein said heat bond is a spot bond.

5. A package according to claim 3 wherein said heat bond is a spot bond.

6. In conjunction with a package including a lid having an integral projecting pull tab for peeling said lid from an associated container, a method of storing the pull tab after securing a peripheral portion of the lid to the container, said method comprising the steps of reversely folding the pull tab on itself adjacent a connection of the pull tab to a remaining portion of the lid, then releaseably anchoring the pull tab to an underlying portion of the lid remote from the lid peripheral portion with that part of the pull tab overlying the lid peripheral portion being free of a heat bond to the lid.

7. The method of claim 6 wherein the pull tab is anchored to the lid by a heat bond between the pull tab and the lid.

* * * * *